United States Patent [19]

Akeret

[11] 4,186,034

[45] Jan. 29, 1970

[54] METHOD OF MANUFACTURING ALUMINUM ALLOY SHEETS CONTAINING MAGNESIUM AND ZINC

[75] Inventor: Rudolf Akeret, Lohningen, Switzerland

[73] Assignee: Swiss Aluminium Ltd., Chippis, Switzerland

[21] Appl. No.: 966,649

[22] Filed: Dec. 6, 1978

[30] Foreign Application Priority Data

Jul. 5, 1978 [CH] Switzerland ..... 7324/78

[51] Int. Cl.[2] ..... C22F 1/04

[52] U.S. Cl. ..... 148/2; 148/11.5 A

[58] Field of Search ..... 148/2, 11.5 A

[56] References Cited

U.S. PATENT DOCUMENTS 4,081,294 3/1978 Thompson et al. ..... 148/11.5 A

*Primary Examiner*—R. Dean

*Attorney, Agent, or Firm*—Bachman and LaPointe

[57] ABSTRACT

The present invention resides in the manufacture of an AlMg alloy sheet with zinc addition which is readily deformable in the soft condition and especially suited for shaping into motor vehicle body components. The alloy sheet has a strength of at least 250 N/mm$^2$, a grain size of less than 50 $\mu$m and, after deformation has occurred, remains free of surface defects such as orange peel effect and Luders bands and also, after a possible influence of heat, remains insensitive to stress corrosion cracking. The zinc addition produces a widening of the working range so that after the last cold rolling operation the alloy can be soft annealed above the recrystallization temperature without coarse grains or Luders band appearing. The zinc addition produces an insensitivity with respect to stress corrosion cracking after a heterogenization annealing subsequent to the soft annealing, even after a sensitization at 150° C. on a sheet which has been deformed with a cold reduction of 20% and more.

7 Claims, 12 Drawing Figures

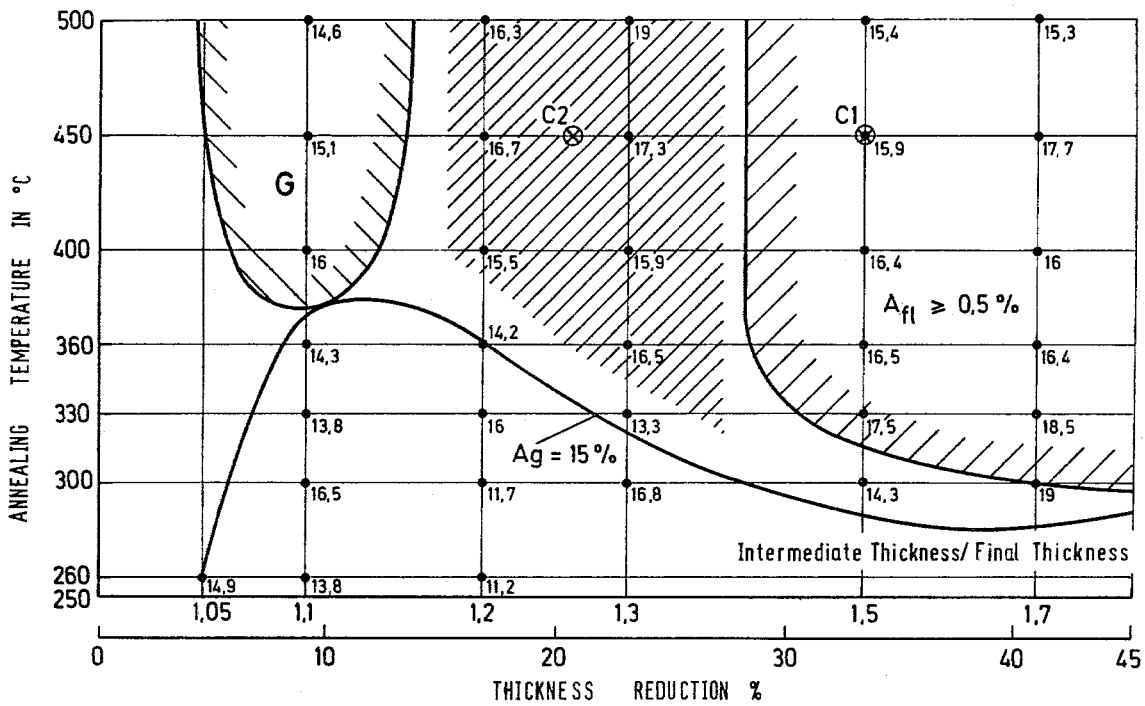

↑ NO CRACKS IN 90d

• SINGLE VALUES

⊙ ALL 10 VALUES

○ VALUES

A 2

C 2

B2

D 2 d
100
50
20
10
5
2
1
0 5 10 20 40 60 %
NO CRACKS IN 90d
ALL 10 VALUES
REMAINING VALUES
SINGLE VALUES

METHOD OF MANUFACTURING ALUMINUM ALLOY SHEETS CONTAINING MAGNESIUM AND ZINC

BACKGROUND OF THE INVENTION

Alloys with 4.5 to 5% magnesium together with additions of manganese and chromium attain, in the soft annealed condition, a tensile strength of 25 to 30 kg/mm$^2$.

However, alloys with high magnesium content display certain peculiarities which must be taken into account during the manufacture of motor vehicle bodies by further cold working by combined deep drawing and stretch drawing.

Flow patterns (corresponding to a marked plastic zone after passing beyond the yield point) cannot be tolerated in external components of bodies. In addition after cold deformation and subsequent storage at elevated temperature, the sheet must not be sensitive to stress corrosion cracking (SCC). Likewise undesirable is the partial disappearance of the strength condition produced during the cold deformation because it is accompanied by a loss in strength and rigidity. Surprisingly, stress corrosion cracking has not been taken into account by the prior art in connection with the use of high magnesium alloy in the manufacture of vehicle bodies even though all the conditions are present to produce stress corrosion cracking namely the presence of deformation zones and internal stresses from deep drawing or stretch drawing, the normal subjection of the bodies to high temperatures (waste heat of the engine, incident sunlight), and the corrosive environment.

Treatments are known in the prior art to eliminate flow patterns. However, these treatments are such that they are not suitable for use on alloys to be used in motor vehicle bodies. These treatments produce a grain diameter above 50 μm which, after cold deformation, leads to a so called orange peel effect on the surface of the cold-formed part, i.e., cold-deformation over the distinct flow zone of beyond about 1% remaining extension, which leads to a great loss in formability. Finally, quenching from a soft annealing temperature in the solution range of about 530° C., brings about a further disadvantage because of the only transient effect which makes storage of the sheet practically impossible and therefore the sheet must be immediately deformed.

Likewise, measures are known for reducing the sensitivity of the high magnesium alloy to stress corrosion cracking. However, the combination of the measures for reducing SCC with the above mentioned treatments for avoiding flow patterns does not result in obtaining good resistance to SCC upon subsequent deformation.

Accordingly, it is the principle object of the present invention to provide an improved process for fabricating good formability, fine grain size aluminum sheet characterized by improved resistance to stress corrosion cracking.

It is a particular object of the present invention to fabricate aluminum sheet stock which is suitable for use in the manufacture of motor vehicle bodies by deep and stretch drawing.

Further objects and advantages will appear hereinbelow.

SUMMARY OF THE INVENTION

In accordance with the present invention the foregoing objects and advantages are readily obtained.

The process of the present invention provides a good formability, fine grain size aluminum alloy sheet characterized by improved resistance to stress corrosion cracking and comprises:

A. Casting an aluminum alloy melt consisting essentially of 4.0 to 7.0% magnesium, 0.5 to 2.0% zinc, 0 to 0.6% silicon, 0 to 0.8% iron, 0 to 1.0% manganese, 0 to 1.0% copper, 0 to 0.3% chromium, 0 to 0.05% bismuth, balance essentially aluminum into a rolling ingot;

B. annealing said cast ingot;

C. hot rolling said annealed ingot to an intermediate thickness;

D. cold rolling in a first series of passes to a thickness of 1.1 to 1.4 times the final thickness;

E. intermediate annealing above the recrystalization temperature of said aluminum alloy;

G. cold rolling to final thickness;

H. annealing above the recrystalization temperature of said alloy;

I. cooling from said annealing temperature at a rate of less than 100° C. per hour to a stabilization temperature of between 200°-260° C.; and J. holding said alloy at said stabilization temperature for from 1 to 24 hours whereby said alloy is characterized by improved stress corrosion properties.

It is possible to cold roll directly to the final thickness from the intermediate thickness after hot rolling. Also the heterogenization can be accomplished by controlling the cooling rate of the alloy from the annealing temperature. By controlling the rate of cooling one can avoid holding the alloy in a temperature zone for a long period of time. The particular rolling operation and cooling rates employed depend on the thickness of the cast, homogenized and surface-machined hot rolling ingot, on the alloy employed, and particularly on the subsequent manufacturing operations.

BRIEF DESCRIPTION OF THE DRAWINGS

FIGS. 1 and 2 represent known alloy composition and FIGS. 3 and 4 represent alloys in accordance with the present invention.

Figure 1:
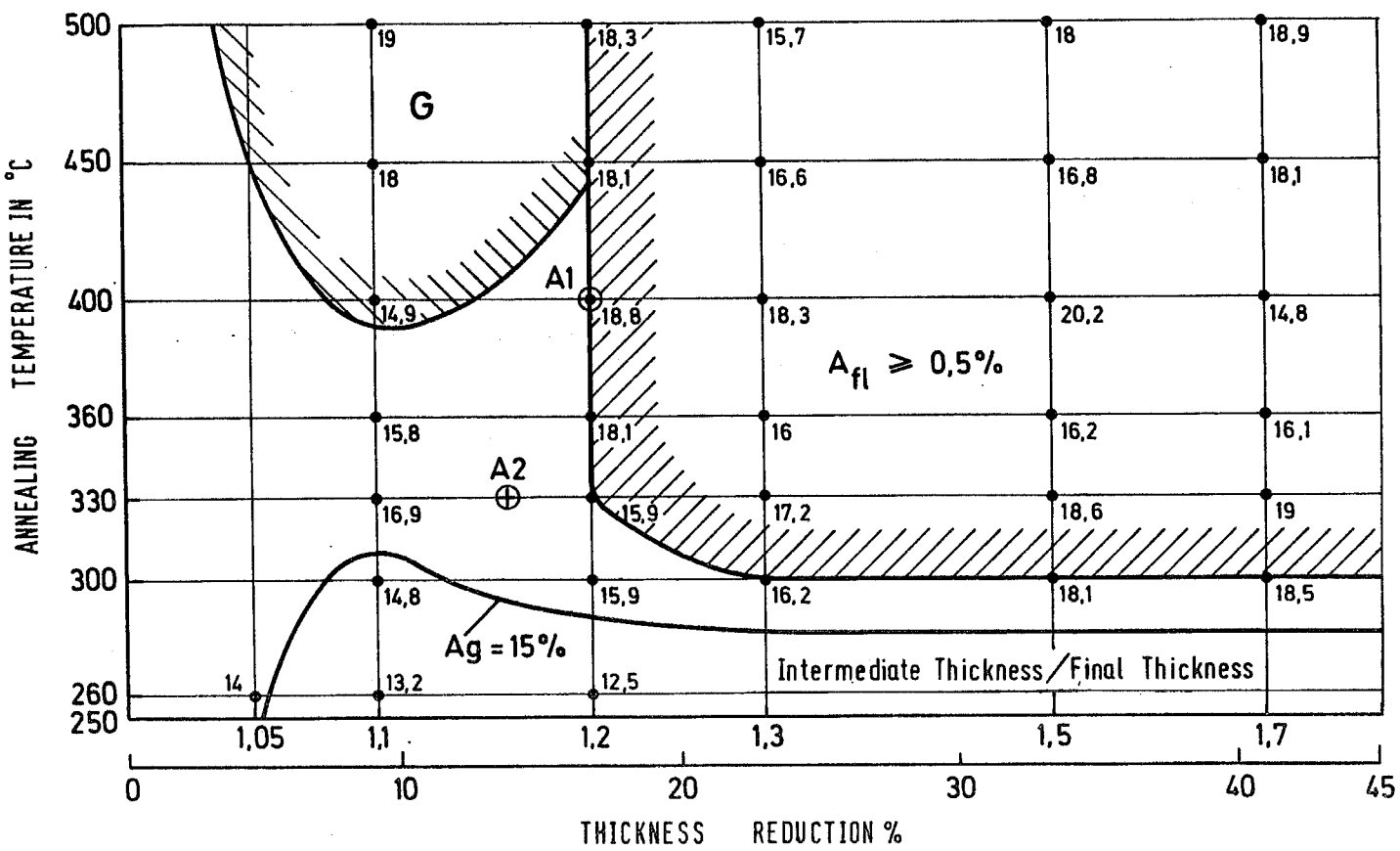
FIGS. 1–4 are graphs illustrating the effective work zones of various alloys.
Figure 2:
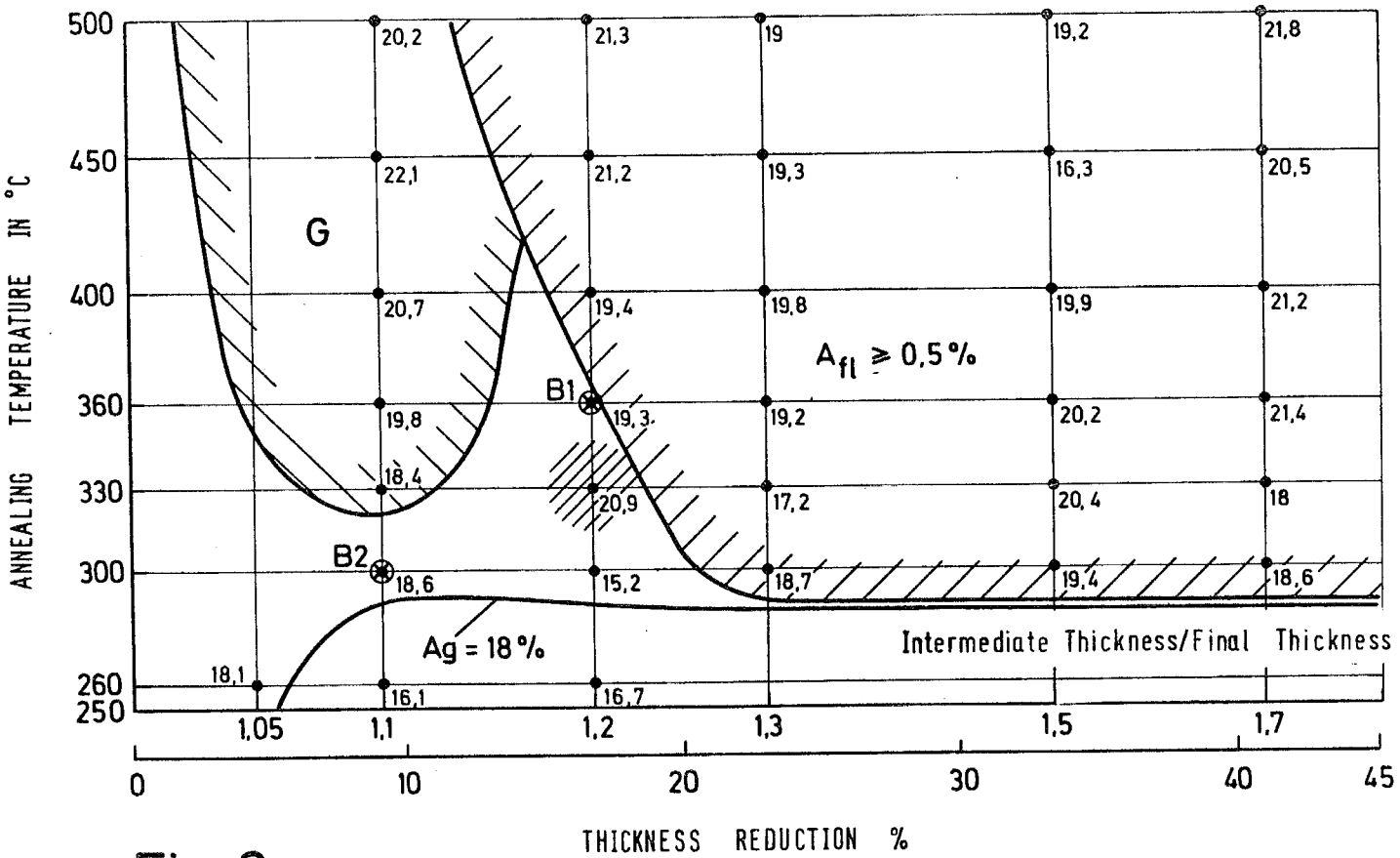
Figure 3:
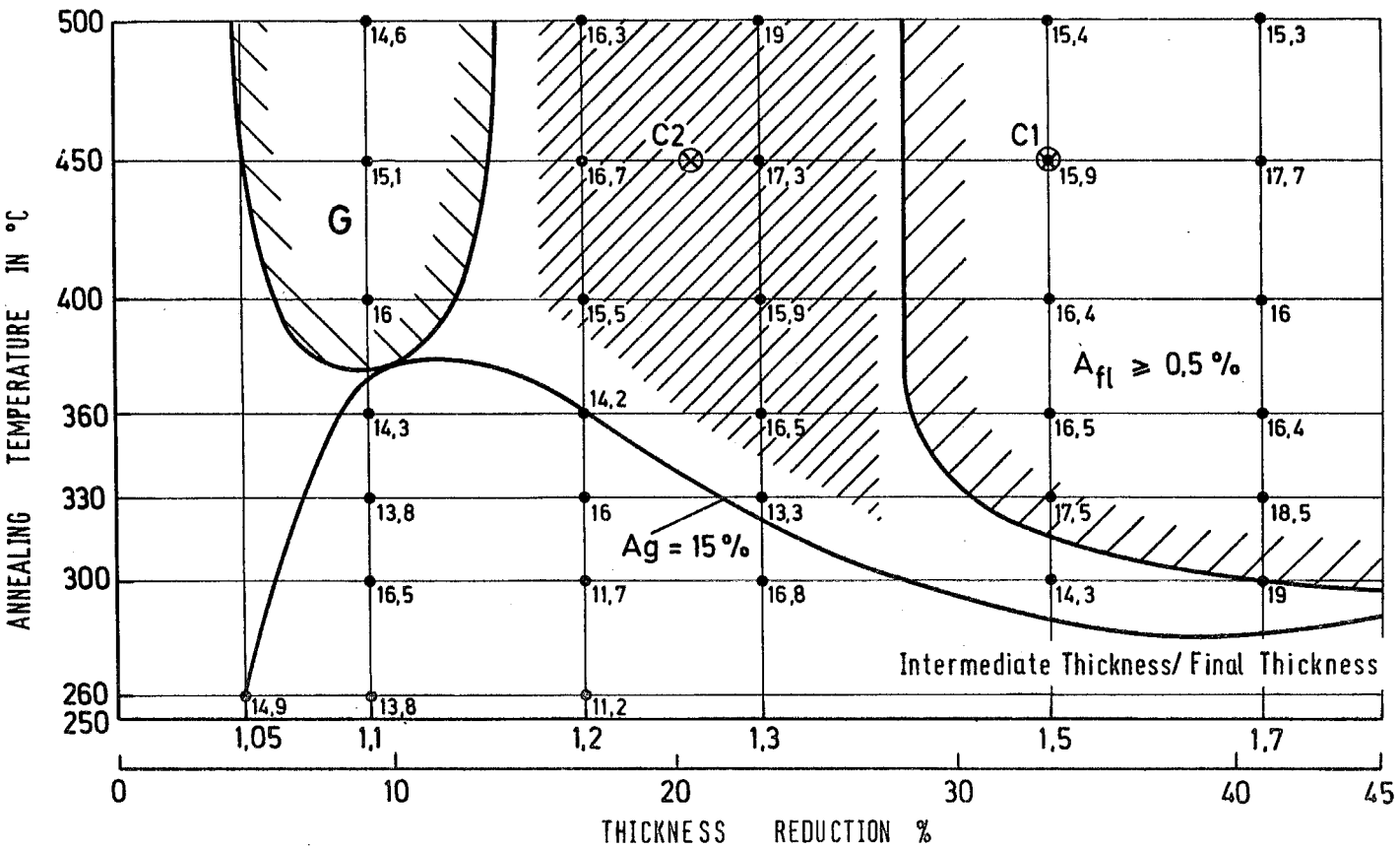
Figure 4:
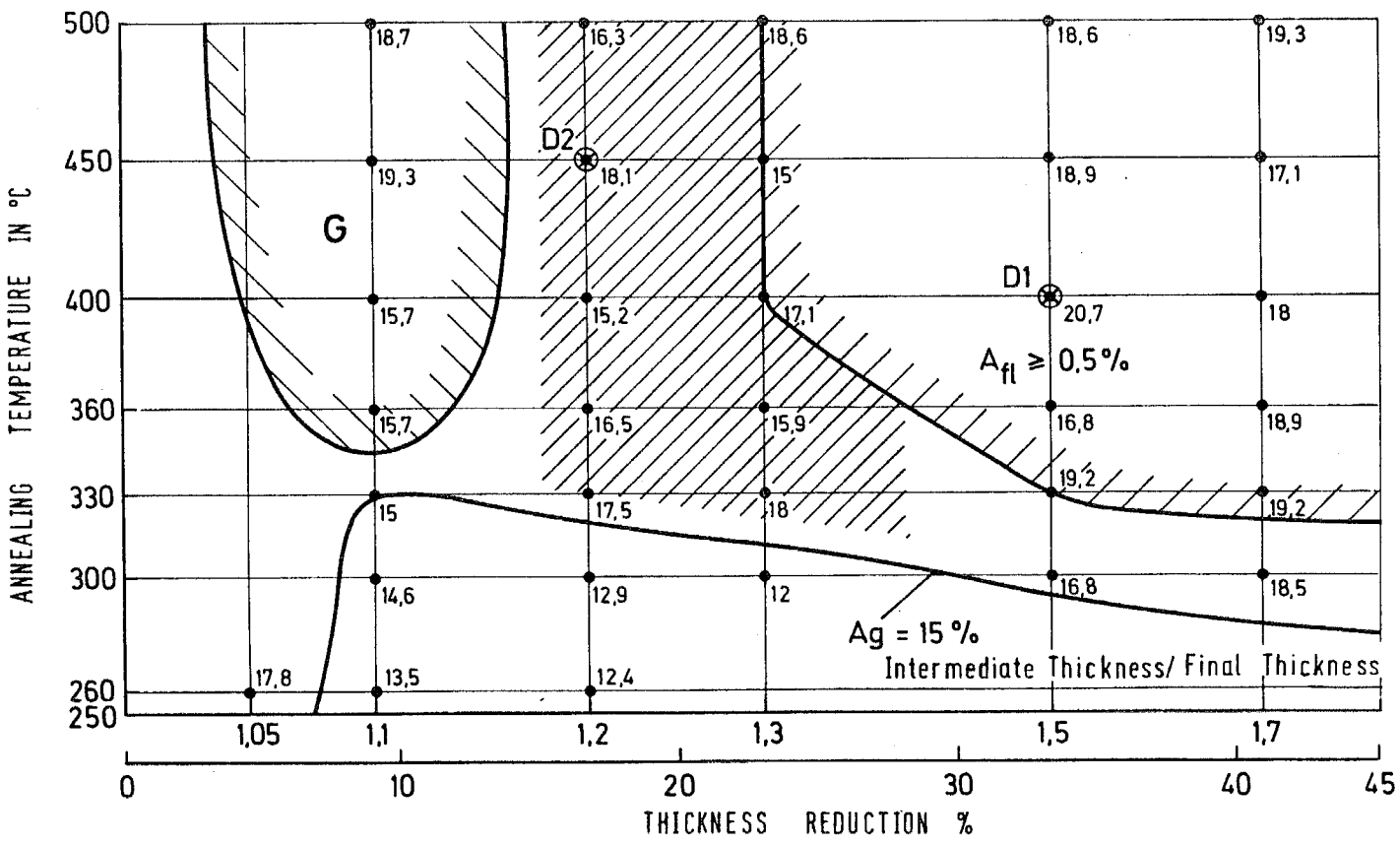

FIGS. *5a–5d* and *6a–6d* illustrate the susceptibility of known alloys to stress corrosion cracking as compared to the alloys of the present invention.

DETAILED DESCRIPTION

The zinc addition of the present invention produce the advantage of widening the working range between coarse grain and flow patterns such that fully soft annealed sheet can be produced which upon subsequent cold deformation shows neither orange peel effect nor flow patterns.

The method of the present invention, especially the effect of the zinc addition on the widening of the working range referred to above, makes it possible for the first time to produce sheets for motor vehicle bodies without having to fear that these sheets, after cold working has occurred in the car factory, will fail by stress corrosion cracking. The method is not limited to the manufacture of sheet stock for motor vehicle construction but is particularly suitable for preparation of sheet stock for use in similar applications where subsequent cold deformation occurs.

In addition to the foregoing, the method of the present invention insures a certainty that cannot be attained with zinc-free aluminum-magnesium alloys. This improvement in certainty facilitates stocking by both a semis manufacturer and a manufacturer of bodies and signifies an economical operation for the semis factory.

The present invention resides in a process of producing fine-grained, high strength, good formability sheet characterized by superior stress corrosion cracking properties. The process comprises casting into a rolling ingot an aluminum alloy consisting essentially of 4.0 to 7.0% Mg; 0.5 to 2.0%, preferably 0.7 to 1.5%, ideally 0.9 to 1.1% Zn; 0 to 1.0% mn; 0 to 0.6% Si; 0 to 0.8% Fe; 0 to 1.0% Cu; 0 to 0.3% Cr, 0 to 0.05% Bi balance essentially aluminum. The essential constituents of the alloy are aluminum, magnesium and zinc. The other elements have not been found to significantly effect the properties of the alloy when present within the limits indicated above. Naturally, any of the foregoing non-essential impurity elements may be present in levels as low as 0.001%.

The process of the present invention comprises;

A. hot rolling the ingot to a sheet of an intermediate thickness;

B. cold rolling said hot rolled sheet to a reduction of at least 20%, preferably 30 to 70%;

C. annealing said cold rolled sheet at a temperature above the recrystallization of the alloy, preferably above 350° C.;

D. cold rolling said sheet to a further reduction of at least 12%, preferably 15 to 30% and ideally 15 to 22%;

E. annealing said cold rolled sheet at a temperature above the recrystallization of the alloy, preferably above 300° C.;

F. cooling said sheet at a rate of less than 100° C. per hour to a stabilizing temperature of between 200° and 260° C.; and G. holding said sheet at said stabilizing temperature for from 1 to 24 hours.

As indicated hereinabove, the resulting material is fine-grained, high strength and exhibits good formability properties and upon subsequent cold working exhibits superior stress corrosion cracking properties and is free from surface defects.

The present invention will be more readily apparent from a consideration of the following examples.

EXAMPLE I

Four alloys, Alloys A, B, C and D with the compositions set forth in Table I below were prepared and compared with one another.

Alloy A corresponds to DIN reference AlMg4.5Mn or AA No. 5083, Alloy B corresponds to DIN reference AlMg5 or approximately AA No. 5056, the two zinc-containing alloys C and D represent alloys in accordance with the present invention.

Each of these alloys was cast into a rolling ingot 70 mm thick, and then homogenized at 480° C. during 6 hours and 550° C. during 12 hours. The surface was then machined and the ingot hot rolled in the usual manner to 4 mm.

The hot rolled ingots were then cold rolled to various thicknesses between 1 mm and 2 mm, which signified a reduction from the starting thickness of 75% to 50%. The cold rolled test pieces were then annealed at 400° C., during which they recrystallized with a fine grain. Thereafter all the test pieces were cold rolled to a final thickness of 1 mm, with cold rolling degrees (percentage reduction of thickness) of 5 to 50%. The finally-cold rolled test pieces were annealed at 200° to 500° C., during which, depending on the degree of cold rolling and the annealing temperature, a recovery or a partial or complete recrystallization could occur.

TABLE I

| Alloy constituent in Wt. % | Alloy A | Alloy B | Alloy C | Alloy D |
|---|---|---|---|---|
| Silicon | 0.15 | 0.15 | 0.15 | 0.15 |
| Iron | 0.25 | 0.22 | 0.22 | 0.22 |
| Manganese | 0.79 | 0.30 | 0.79 | 0.30 |
| Magnesium | 4.38 | 4.66 | 4.17 | 4.67 |
| Zinc | — | — | 0.97 | 1.00 |
| Chromium | 0.11 | — | 0.11 | 0.14 |
| Bismuth | 0.026 | 0.024 | 0.024 | 0.026 |
| Aluminum[x] | balance | balance | balance | balance |

[x]plus usual impurities dependent on the recovery process

FIGS. 1 to 4 show the values of the uniform elongation $A_g$ as well as the coarse grain zone (G) and the zone where flow patterns type A (Luders lines) occur ($A_{fl}>0.5\%$) for the individual alloys A, B, C and D depending on the annealing temperature and the reduction in thickness during cold rolling.

The uniform elongation serves as a measure of the formability during stretch forming or deep drawing. It was determined from the elongation values $A_{10}$ and $A_5$ derived in tensile tests according to the Kostron formula (H. Kostron "Zur Mathematik des Zügversuches", Archiv für das Eisenhuttenwesen, 22, 1951, page 317 et seq.).

The yield to tensile strength ratio, R0.2/Rm, also serves as a measure of formability where the lower the values of R0.2/Rm the greater the formability during deep drawing and stretch forming. Additional information is given over the degree of softening by the annealing.

TABLE II

| Alloy | Anneal temp °C. | Intermediate thickness mm | ε % | Rm kp/mm² | R0.2 | R0.2/Rm % | $A_g$ % | $A_{fl}$ % | Grain size μm |
|---|---|---|---|---|---|---|---|---|---|
| A | 330 | 1.1 | 9 | 32.9 | 18.5 | 56 | 16.9 | 0 | not re- |
| | 360 | 1.1 | 9 | 32.8 | 18.1 | 55 | 15.8 | 0 | crystal- |
| | 300 | 1.2 | 16 | 31.0 | 14.5 | 47 | 15.9 | 0.3 | lized |
| B | 260 | 1.2 | 16 | 30.2 | 18.6 | 62 | 16.7 | 0 | not recrys- |
| | 300 | 1.2 | 16 | 27.2 | 11.3 | 42 | 15.8 | 0.5 | tallized |
| | 330 | 1.2 | 16 | 27.2 | 11.2 | 42 | 20.9 | 0.4 | 38 |
| C | 330 | 1.2 | 16 | 30.0 | 11.9 | 40 | 16.0 | 0.1 | 34 |
| | 360 | 1.2 | 16 | 30.2 | 11.9 | 40 | 14.2 | 0 | 35 |
| | 400 | 1.2 | 16 | 30.3 | 11.9 | 40 | 15.5 | 0 | 30 |
| | 450 | 1.2 | 16 | 30.2 | 11.9 | 40 | 16.7 | 0 | 29 |
| | 500 | 1.2 | 16 | 29.9 | 11.6 | 39 | 16.3 | 0 | 36 |
| | 330 | 1.3 | 23 | 30.1 | 12.1 | 40 | 13.3 | 0.4 | 24 |

TABLE II-continued

| Alloy | Anneal temp °C. | Intermediate thickness mm | ε % | Rm kp/mm² | R0.2 | R0.2/Rm % | $A_g$ % | $A_{fl}$ % | Grain size μm |
|---|---|---|---|---|---|---|---|---|---|
| | 360 | 1.3 | 23 | 30.5 | 12.5 | 41 | 16.5 | 0.4 | 26 |
| | 400 | 1.3 | 23 | 30.4 | 12.6 | 41 | 15.9 | 0.4 | 26 |
| | 450 | 1.3 | 23 | 30.4 | 12.4 | 41 | 17.3 | 0.3 | 26 |
| | 500 | 1.3 | 23 | 30.1 | 12.2 | 41 | 19.0 | 0.4 | 26 |
| D | 330 | 1.2 | 16 | 29.9 | 11.9 | 40 | 17.5 | 0 | 46 |
| | 360 | 1.2 | 16 | 30.1 | 11.9 | 40 | 16.5 | 0 | 40 |
| | 400 | 1.2 | 16 | 29.8 | 12.0 | 40 | 15.2 | 0.25 | 36 |
| | 450 | 1.2 | 16 | 29.6 | 11.9 | 40 | 18.1 | 0.3 | 38 |
| | 500 | 1.2 | 16 | 29.8 | 12.0 | 40 | 16.3 | 0.2 | 32 |
| | 330 | 1.3 | 23 | 30.3 | 12.6 | 42 | 18 | 0.3 | 30 |
| | 360 | 1.3 | 23 | 30.2 | 12.7 | 42 | 15.9 | 0.4 | 20 |
| | 400 | 1.3 | 23 | 30.0 | 12.6 | 42 | 17.1 | 0.5 | 26 |
| | 450 | 1.3 | 23 | 29.7 | 12.6 | 42 | 15 | 0.5 | 14 |
| | 500 | 1.3 | 23 | 29.6 | 12.6 | 42 | 18.6 | 0.5 | 29 |

Notes:
ε = Thickness reduction from intermediate thickness to 1 mm final thickness
Rm = Tensile strength
R0.2 = Elastic limit
R0.2/Rm = Yield to tensile ratio
$A_g$ = Uniform elongation$A_{fl}$ = Extension in marked plastic zone In the figures the working ranges for the alloys A-B-C-D are indicated. These working ranges lie within an area which is delimited by the boundaries of coarse grain structure and of flow patterns type A, as well as by the contour line for the uniform elongation $A_g$ of about 15%. Beyond this, the sheet must be totally recrystallized.

Since the tensile strength of all alloys for all combinations of thickness reduction and annealing temperature shown has remained above 27 kp/mm² (270 N per mm²), a tabular rendering of the total experimental area is omitted.

Table II sets forth the individual values collected from the tensile test in dependence on the annealing temperature (annealing period 1 h), cold rolling degree and grain size. Among other things, the results show the expected correlation between the yield to tensile ratio R0.2/Rm and the degree of softening. The values of R0.2/Rm of 39 to 42% were observed with grain sizes of 14 to 40 μm (alloys C and D) while the values of R0.2/Rm of 47 to 62% were observed where no recrystallization had yet occurred (alloy A and B). With alloy A there was no working range and with alloy B the only working range was around one single point.

A coarse grain is understood to mean a grain diameter of more than 50 μm. As a measure for the working range of each alloy there can serve the area in cm² of the zone indicated with shading in FIGS. 1 to 4 according to the named criteria. The result for alloy A is an area of zero in.², for alloy B an area of about 0.3 in.², for alloy C an area of about 6.7 in.² and for alloy D an area of about 6.7 in.².

The zinc addition to the alloys C and D as is evident from the above results brings a significant and hitherto unknown broadening of the working range because the flow patterns first appear with smaller grain sizes.

Above all else, the annealing treatment of the alloys of the present invention can be selected so as to always result in a complete recrystallization of the cold-rolled sheet.

EXAMPLE II

With reference to FIGS. 1 to 4, the alloys having the combination of reduction in thickness and annealing temperature indicated by points A1/A2, B1/B2, C1/C2, and D1/D2 were selected for testing the stress corrosion cracking particles. The annealing period of all the test alloys was one hour.

The alloys A1, A2, B1 and B2 are known alloys whose behavior in stress corrosion cracking before and after a new cold deformation has occurred are compared with the alloys according to the present invention C2 and D2.

The versions C1 and D1 lie within the area where flow patterns occur, i.e., the area which is characterized by plastic extensions in the marked flow zone of more than 0.5%. These sheets can be employed where it does not matter whether flow patterns occur or not such as in the internal construction of a motor vehicle or the like.

Table II below represents the starting parameters of the alloys indicated in FIGS. 1 to 4.

The marked flow zone for the alloys A1–D1 corresponds to a plastic extension of 0.5–0.7% and for the alloys A2–D2 to a plastic extension of 0–0.5%.

The stress corrosion cracking properties of the alloys were tested by means of U-bend-specimens in accordance with DIN 50908/1964 for a duration of up to 90 days. For these tests, the soft annealed or weakened and heterogenized sheets of alloys A1 to D1 and A2 to D2 were cold rolled with thickness reductions of from 0% to 60% and then subjected for 3 days to a temperature of 150° C. to make them sensitive to stress corrosion cracking.

TABLE III

| Alloys | Rm kp/mm² | Rp kp/mm² | Rp/Rm % | $A_g$ % | $A_{fl}$ % | Grain size μm | Criteria met? |
|---|---|---|---|---|---|---|---|
| A1 | 30.7 | 13.1 | 42.6 | 18.8 | 0.6 | <50 | no, not free of flow patterns |
| A2 | 30.5 | 13.2 | 43.3 | 15.9 | 0.5 | not recryst. | no, no recrystallization |
| B1 | 27.4 | 11.4 | 41.6 | 19.3 | 0.7 | 35 | no, not free of flow patterns |
| B2 | 28.9 | 15.2 | 55.0 | 18.6 | 0 | not recryst. | no, no recrystallization |
| C1 | 30.6 | 13.7 | 44.7 | 15.9 | 0.6 | 25 | no, not free of flow patterns |
| C2 | 30.1 | 12.1 | 40.2 | 16.3 | 0.2 | 28 | yes |

TABLE III-continued

| Alloys | Rm kp/mm² | Rp kp/mm² | Rp/Rm % | $A_g$ % | $A_{fl}$ % | Grain size μm | Criteria met? |
|---|---|---|---|---|---|---|---|
| D1 | 30.2 | 13.6 | 45 | 20.7 | 0.7 | 24 | no, not free of flow patterns |
| D2 | 29.6 | 11.9 | 40.2 | 18.1 | 0.3 | 38 | yes |

Rm = Tensile strength
Rp = Elastic limit
Rp/Rm = Yield to tensile ratio
$A_g$ = Uniform elongation
$A_{fl}$ = Extension in marked plastic zone The testing solution consisted of: 30 g NaCl, 5.44 g $CH_3COONa.3H_2O$, 5.68 g $Na_2Cr_2O_7.2H_2O$ balance de-ionized water to 1 liter solution, appr. 7.5 ml acetic acid (>98%) added, to stabilize the solution at a pH of 4. Testing temperature was 25° C.

Alloys A1, B1, C1 and D1 were heterogenized at 220° C. for 8 hours. The results of the tests are shown graphically in FIGS. 5*a*, 5*b*, 5*c* and 5*d*. A similar graphic showing is given in FIGS. 6*a*–6*d* for the alloys A2, B2, C2 and D2 which were heterogenized by simply slow cooling from an annealing temperature of 400° C. to 250° C. in 4 hours.

Figure 5A:
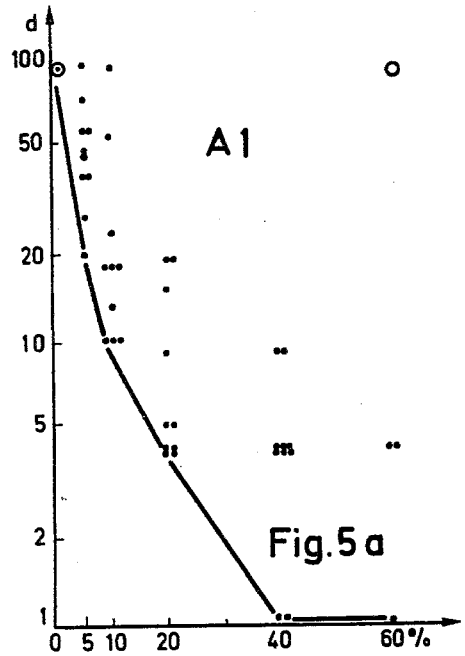
Figure 5C:
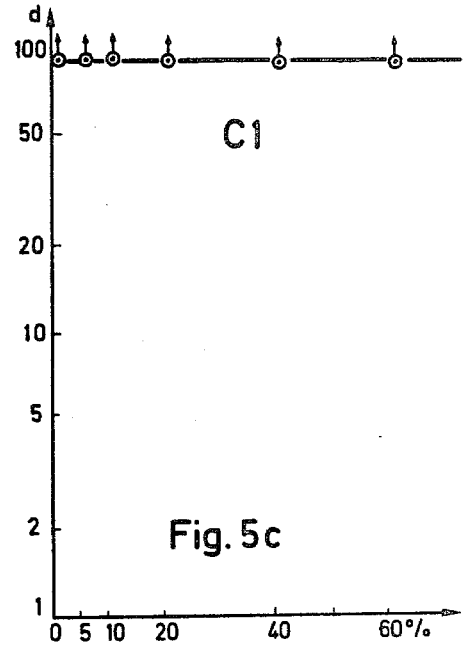
Figure 5B:
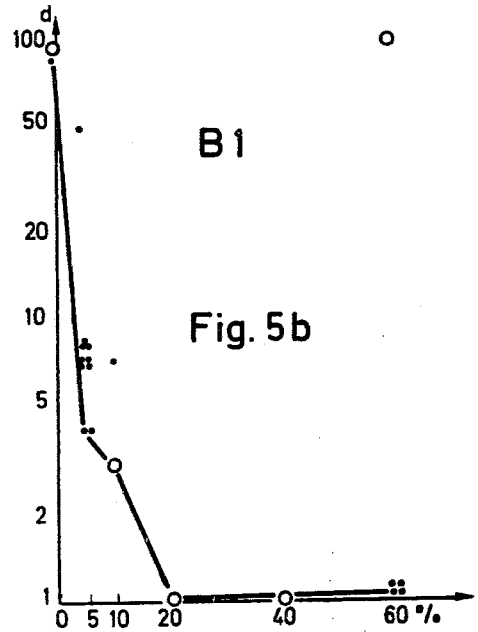
Figure 5D:
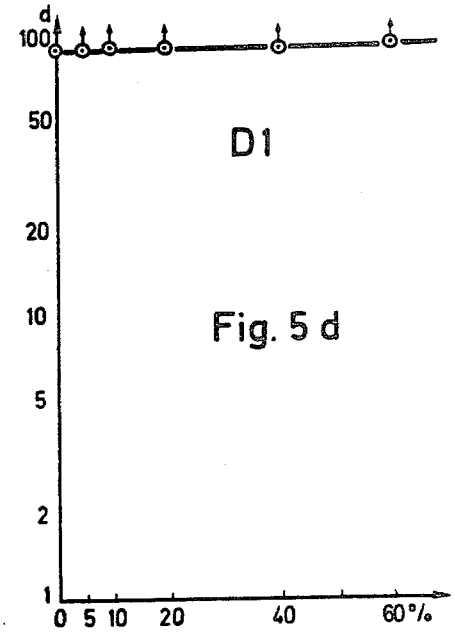
Figures 6A, 6B, 6C, 6D:
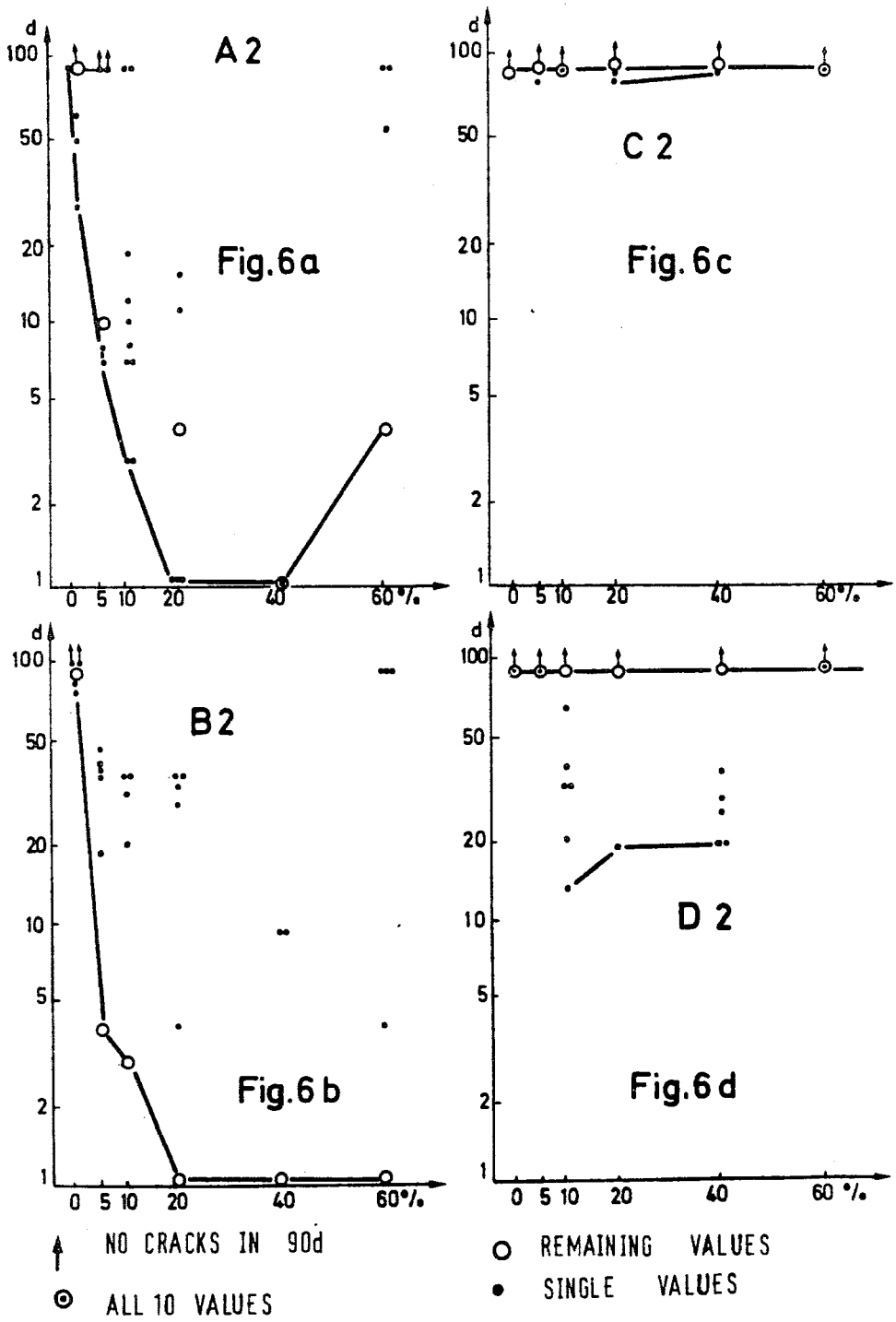

For an understanding of FIGS. 5 and 6 an explanation of FIG. 5*a* which represents alloy A1 is sufficient. The life of the alloys in days is shown as a function of % reduction in thickness for rolling degrees of 0%, 5%, 10%, 20%, 40% and 60%. Ten (10) specimens were tested for each rolling degree.

In order to compare the alloys C2 and D2 and C1 and D1 with the alloys A2 and B2 and A1 and D1 respectively the corresponding diagrams are arranged adjacent to each other and the point with the lowest life are connected by straight lines where possible.

As can be seen in the zinc-free alloys A and B a polygon can be drawn independently of the degree of cold deformation. This is not possible with the zinc-containing alloys C1 and D1 and with the alloy C2 where one obtains a single straight line between 20 and 40% cold deformation and with the alloy D2 the polygon begins at 10% and ceases at 40%.

Even the points of the tests which show no cracks after lapse of 90 days (indicated with an arrow) were likewise connected together with straight lines. With the zinc-containing alloys C and D it was possible to run a straight line through all the points with a life of over 90 days independently of the degree of deformation whereas with the zinc-free alloys A1 and B1 this was in general not possible and with A2 and B2 could only be done where the degree of deformation was between 0 and 5%.

Despite incomplete heterogenization, the alloys according to the present invention C2 and D2 are essentially less sensitive to SCC than the zinc-free comparative alloys A2 and B2.

The results established that, by a heterogenization in addition to soft annealing, one can succeed in taking sheets of AlMg4.5Mn or AlMg5 in the condition in which they leave the pre-form factory and make them more or less insensitive to stress corrosion cracking. With the alloys A1 and B1, which were heterogenized at 220° C. for 8 hours, this was achieved better than with the alloys A2 and B2, wich were slowly cooled to 250° C. after the softening or recovery annealing.

However, after a cold deformation of more than 20%, the sheets of AlMg4.5Mn and AlMg5 again become sensitive to stress corrosion cracking after long exposure to moderately high temperatures. Cold deformation in this zone can occur during the production of motor vehicle bodies which combined stretch drawing and deep drawing.

However, if the heterogenization treatment is undertaken on an AlMg alloy with a purposeful zinc addition the sheet remains insensitive with respect to stress corrosion cracking even in cases where cold deformation occurs before the critical heat influence (sensitization).

The bodies of motor vehicles fabricated from sheets of zinc-containing AlMg alloys which have been produced by the manufacturing method according to the present invention bring to the manufacturer and purchases of motor vehicles no problems regarding cracks which have arisen through stress corrosion cracking. A further advantage for the manufacturer of motor vehicles arises from the fact that prepared body work components can be stored without surface protection.

The heterogenization annealing after the last soft annealing produces in zinc-containing AlMg alloys finely dispersed precipitations of MgZn phases in the grain interior. The heterogenization annealing with zinc-free AlMg alloys produces precipitations of AlMg phases only in the grain boundaries so that the deformation bands which arise during subsequent deformation while under the influence of elevated temperatures precipitations can occur which lead to stress corrosion cracking.

What is claimed is:

1. A process for producing fine-grained, high strength, good formability sheet characterized by superior stress corrosion cracking properties upon subsequent cold deformation by deep and stretch drawing comprising:

A. casting an aluminum alloy melt consisting essentially of 4.0 to 7.0% magnesium, 0.5 to 2.0% zinc, balance essentially aluminum into a rolling ingot;

B. hot rolling to an intermediate thickness;

C. cold rolling to a final thickness;

D. annealing above the recrystallization temperature of said alloy so as to produce a grain size of less than 50 μm; and E. cooling from said annealing temperature to a stabilization temperature of between 200° and 260° C. at a rate of less than 100° C. per hour, said alloy sheet being free from flow patterns and characterized by superior stress corrosion cracking properties upon subsequent cold deformation.

2. The process of claim 1 wherein said alloy melt comprises 0.7 to 1.5% Zn.

3. The process according to claim 1 wherein said alloy melt comprises 0.9 to 1.1% Zn.

4. The process according to claim 1 wherein said alloy melt further comprises 0 to 0.6% Si, 0 to 0.8% Fe, 0 to 1.0% Mn, 0 to 1.0% Cu, 0 to 0.3% Cr and 0 to 0.05% Bi.

5. The process according to claim 1 wherein said cold rolling comprises the steps of:

A. cold rolling to a reduction of at least 20%, preferably 30 to 70%;

B. annealing said cold rolled strip above the recrystallization temperature of the alloy; and C. cold rolling to final thickness to a further reduction of at least 12%, preferably 15 to 30% and ideally 15 to 22%.

6. The process according to claim 1 further including the step of holding said sheet at said stabilization temperature for from 1 to 24 hours.

7. The process according to claim 1 further including the step of manufacturing motor vehicle bodies by drawing from said sheet.

* * * * *

UNITED STATES PATENT AND TRADEMARK OFFICE

CERTIFICATE OF CORRECTION

PATENT NO. : 4,186,034

DATED : January 29, 1980

INVENTOR(S) : Rudolf Akeret

It is certified that error appears in the above-identified patent and that said Letters Patent are hereby corrected as shown below:

On the cover page the issue date which now reads "Jan. 29, 1970" should be changed to read --Jan. 29, 1980--.

In Column 3, line 15, change "mn" to read --Mn--.

Signed and Sealed this

*Thirteenth* Day of *May 1980*

[SEAL]

*Attest:*

SIDNEY A. DIAMOND

*Attesting Officer*

*Commissioner of Patents and Trademarks*